US007755465B2

(12) United States Patent
Yang

(10) Patent No.: US 7,755,465 B2
(45) Date of Patent: Jul. 13, 2010

(54) TEMPERATURE CONTROL SWITCH

(75) Inventor: Wen Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 178 days.

(21) Appl. No.: 12/081,873

(22) Filed: Apr. 23, 2008

(65) Prior Publication Data

US 2009/0267724 A1 Oct. 29, 2009

(51) Int. Cl.
*H01H 37/60* (2006.01)
*H01H 37/52* (2006.01)
*H01H 37/54* (2006.01)
*H01H 37/14* (2006.01)

(52) U.S. Cl. ..... 337/363; 337/380; 337/334; 337/318; 337/365; 337/377

(58) Field of Classification Search ..... 337/380, 337/334, 363, 318, 365, 377; 200/336
See application file for complete search history.

(56) References Cited

U.S. PATENT DOCUMENTS 3,638,157 A * 1/1972 Kruzic ..... 337/6
3,656,182 A * 4/1972 Staples ..... 337/319
3,688,060 A * 8/1972 Risk ..... 200/409
3,733,460 A * 5/1973 Ryckman, Jr. ..... 392/475
3,737,825 A * 6/1973 Summe et al. ..... 337/91
3,743,992 A * 7/1973 Ramsey et al. ..... 337/48
3,892,981 A * 7/1975 Bauer ..... 307/117
3,893,054 A * 7/1975 Marcoux et al. ..... 337/37
3,905,003 A * 9/1975 Rosenberg et al. ..... 337/54
3,943,479 A * 3/1976 Turner ..... 337/347
4,258,349 A * 3/1981 Flory ..... 337/46
4,363,015 A * 12/1982 Branson et al. ..... 337/117
4,510,479 A * 4/1985 Merchant ..... 337/91
4,559,510 A * 12/1985 Franz ..... 335/13
5,012,495 A * 4/1991 Munroe et al. ..... 337/3
5,021,762 A * 6/1991 Hetrick ..... 337/103
5,191,310 A * 3/1993 Obermann et al. ..... 337/105
5,223,813 A * 6/1993 Cambreleng et al. ..... 337/66
5,451,729 A * 9/1995 Onderka et al. ..... 200/18
5,453,725 A * 9/1995 You et al. ..... 337/68
5,491,460 A * 2/1996 Krasser et al. ..... 337/70
5,541,569 A * 7/1996 Jang ..... 337/68
5,694,106 A * 12/1997 Wang ..... 337/79
5,760,672 A * 6/1998 Wang ..... 337/79
5,889,457 A * 3/1999 Hsu et al. ..... 337/59

(Continued)

*Primary Examiner*—Jayprakash N Gandhi
*Assistant Examiner*—Bradley H Thomas
(74) *Attorney, Agent, or Firm*—Bacon & Thomas, PLLC

(57) ABSTRACT

A temperature control switch comprises a switch casing, which contains a springy slice, where the springy slice is provided with a thermostatic bimetal strip on its bouncing end. The thermostatic bimetal strip is provided with an electric heating device, where the first end and second end of the device are respectively connected in series between a first control terminal and the thermostatic bimetal strip. The elevated end of the thermostatic bimetal strip links one end of an uplifted metal slice to form an incompletely fixed link point, while the other end of the uplifted metal slice features a swaying contact, which corresponds to the contact point that a second control terminal joins. When subjected to heat, the one end of the thermostatic bimetal strip deforms, enabling the swaying contact to separate from the contact point, thus preventing the contact point from being damaged by the heat.

10 Claims, 6 Drawing Sheets

U.S. PATENT DOCUMENTS 6,057,751 A * 5/2000 Hung et al. ..... 337/377
6,072,381 A * 6/2000 Yu ..... 337/37
6,075,436 A * 6/2000 Hsu ..... 337/363
6,094,126 A * 7/2000 Sorenson ..... 337/37
6,154,116 A * 11/2000 Sorenson ..... 337/37
6,249,209 B1 * 6/2001 Yu ..... 337/37
6,252,489 B1 * 6/2001 Chen ..... 337/37
6,275,133 B1 * 8/2001 Chen ..... 337/37
6,307,459 B1 * 10/2001 Yu ..... 337/37
6,307,460 B1 * 10/2001 Yu ..... 337/37
6,353,380 B1 * 3/2002 Yu ..... 337/37
6,417,756 B1 * 7/2002 Yu ..... 337/66
6,445,273 B1 * 9/2002 Yu ..... 337/37
6,445,275 B2 * 9/2002 Yu ..... 337/68
6,448,880 B2 * 9/2002 Yu ..... 337/66
6,456,185 B1 * 9/2002 Yu ..... 337/37
6,462,292 B1 * 10/2002 Wang ..... 200/315
6,469,610 B1 * 10/2002 Chen ..... 337/66
6,512,441 B1 * 1/2003 Yu ..... 337/37
6,617,952 B1 * 9/2003 Yu ..... 337/94
6,664,884 B1 * 12/2003 Yu ..... 337/59
6,713,704 B1 * 3/2004 Yu ..... 200/520
6,800,826 B1 * 10/2004 Yu ..... 200/520
6,815,626 B1 * 11/2004 Hsu ..... 200/315
6,984,798 B1 * 1/2006 Lu ..... 200/334
6,992,559 B2 * 1/2006 Huang ..... 337/66
7,005,597 B2 * 2/2006 Mori ..... 200/336
7,236,082 B2 * 6/2007 Kuo ..... 337/66
7,248,140 B2 * 7/2007 Yu ..... 337/94
7,283,031 B2 * 10/2007 Huang ..... 337/66
7,312,687 B2 * 12/2007 Ullermann ..... 337/66
7,317,375 B2 * 1/2008 Yu ..... 337/94
7,583,174 B2 * 9/2009 Yu ..... 337/59
7,583,175 B2 * 9/2009 Yu ..... 337/59
7,626,482 B2 * 12/2009 Huang ..... 337/59
2001/0006145 A1 * 7/2001 Yu ..... 200/524
2001/0006365 A1 * 7/2001 Yu ..... 337/68
2002/0011917 A1 * 1/2002 Frank ..... 337/337
2005/0062580 A1 * 3/2005 Nakajima ..... 337/321
2006/0197645 A1 * 9/2006 Yu ..... 337/66
2007/0001798 A1 * 1/2007 Yu ..... 337/66

* cited by examiner

TEMPERATURE CONTROL SWITCH

BACKGROUND OF THE INVENTION

1. Field of the Invention

The present invention relates to temperature control switches and, more particularly, to one which switches on and switches off promptly, subject to a predetermined temperature.

2. Description of the Prior Art

Temperature control switches are usually used in the load circuit of high power heating appliances (for instance: electric oven), which helps to keep the temperature at the predetermined set point, where the predetermined temperature is adjustable. Conventional temperature control switches usually comprise a casing, where the housing contains two control terminals which feature switching function, and the first control terminal joins a thermostatic bimetal strip that tends to deform due to temperature changes. The thermostatic bimetal strip is provided with a contact that joins the second control terminal; an electric heating device (relatively low power), having its one end connected to the power supply, while the other end to the thermostatic bimetal strip; the casing contains a cam for the regulation of the rotation, where the cam jostles against the bottom part of the thermostatic bimetal strip. Through rotating the cam, the regulation over the magnitude of being uplifted of the thermostatic bimetal strip is then available.

As a voltage is applied across the control terminals, the load circuit of the controlled heating appliance is being activated; meanwhile, the electric heating device located in the temperature control switch is conducted to heat, enabling an uplifted deformation of the thermostatic bimetal strip, subject to a temperature change, which makes the contact on the thermostatic bimetal strip apart from the second control terminal, enabling the electric heating device to be disconnected from the electricity supply and quitted to heat. The thermostatic bimetal strip begins to cool and rebounds off the uplifting, until the contact on the thermostatic bimetal strip joins the second control terminal again, which reactivates the electric heating device to heat. By controlling the cyclic behavior of switching on and off the electric power for the electric heating device of the temperature control switch, to realize the function of controlling the working environment for the high power heating appliance within the predetermined temperature. As the cam is activated to rotate, the predetermined temperature can be altered by changing the magnitude of the uplifting of the thermostatic bimetal strip; therefore, a new temperature is arrived by heating the thermostatic bimetal strip, and at this moment the magnitude of deformation is thus enough to make the strip to depart from the second control terminal which results in an electric disconnection.

However, the problems with the prior art temperature control switches lie in the slowness and smoothness of switch-on and switch-off for the electric power between the contact on the thermostatic bimetal strip and the second control terminal, which is substantially easy to bring forth sparks and high heat, resulting an easy destruction of the contact by fire.

SUMMARY OF THE INVENTION

The objective of the present invention is to provide a temperature control switch, which carries out the regulation of switching according to the predetermined temperature, and expedites the electric power connection and disconnection about the contact point, which disables the possibility of being destroyed in fire owing to high heat.

To accomplish the aforesaid objective, the temperature control switch of the present invention comprises: a switch casing, composed of a top and a base; a first control terminal, formed by having a conductive substance shaped into one piece, and setting it up on the base; a second control terminal, formed by having a conductive substance shaped into one piece, setting it up on the base, and connecting it to a contact point; a springy slice, connected electrically to the first control terminal; a thermostatic bimetal strip, having its one end and the springy slice joining in an electrically insulated way, while the other end features an elevated end; an electric heating device, set up on the thermostatic bimetal strip, where the electric heating device comprises first and second ends, which form a series connection between the first control terminal and the thermostatic bimetal strip; an uplifted metal slice, with one end joining the elevated end of the thermostatic bimetal strip, to form an incompletely fixed link point, while the other end features a swaying contact, which is set up at the place corresponding to the contact point that the second control terminal joins; a springy element, with one end fastened at the switch casing by a fastener, and the other end hooks the center portion of the uplifted metal slice, which enables the resilience from the stretch due to the hooking, where the resilience pulls the uplifted metal slice at the hook; and a regulative cam, set up inside the switch casing, and exerts on the springy slice through a chain action.

As in the aforesaid invention, the springy slice is a springy metal slice, fixedly joins the first control terminal, such that the first end of the electric heating device connects electrically to the first control terminal through the springy metal slice.

As in the aforesaid invention, the electric heating device is an alloy resistor, where a first insulated slice is set up between the alloy resistor and the thermostatic bimetal strip.

As in the aforesaid invention, the alloy resistor is set up on the backside of the thermostatic bimetal strip.

As in the aforesaid invention, the electric heating device is an alloy resistor, where the first end of the alloy resistor connects fixedly and electrically to the springy metal slice, and a first insulated slice is set up between the alloy resistor and the thermostatic bimetal strip, while the springy metal slice is provided with a bouncing end located in between alloy resistor and the first insulated slice.

As in the aforesaid invention, the second end of the alloy resistor connects electrically to the elevated end of the thermostatic bimetal strip.

As in the aforesaid invention, the alloy resistor is provided with an arc portion on the second end, which connects fixedly and electrically to the elevated end of the thermostatic bimetal strip.

As in the aforesaid invention, the springy slice is provided with a regulative pole thereon which is located toward the regulative cam, and the pole has an arc portion at its bottom end, where the regulative cam acts on the arc portion and again to the springy slice through the chain action.

As in the aforesaid invention, the regulative cam is provided with a first annular surface thereon, where the annular surface starts from the low end to step up gradually up to the high end which is a terminal fringe, and the action is done by taking the first annular surface jostling against the arc portion of the regulative pole.

As in the aforesaid invention, the switch casing is provided with a third control terminal and a fourth control terminal, where the third control terminal has a deflected springy slice which is provided with a dynamic contact point near its bottom end, while the fourth control terminal has a fixed contact point which conductively joins the dynamic contact point of the deflected springy slice, and the regulative cam is again provided with a second annular surface, where the action is done by taking the second annular surface pressing on the deflected springy slice.

DETAILED DESCRIPTION OF THE INVENTION

Figure 1:
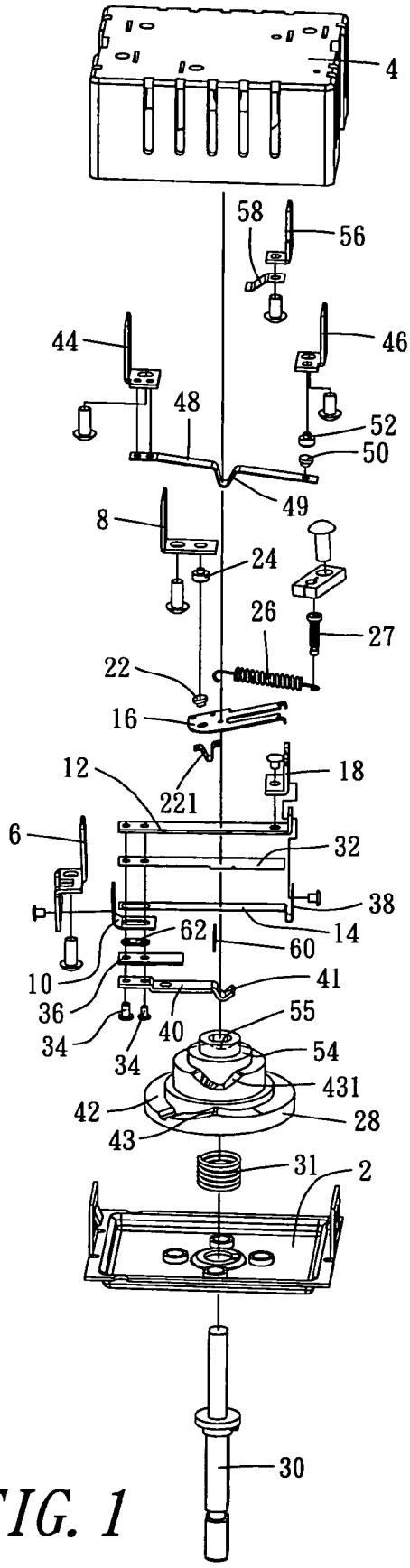
FIG. 1 is a three-dimensional exploded view of the exemplified embodiment of the present invention.

To achieve the aforesaid objective of this invention, the techniques adopted and functions achieved are detailed described with reference to the following preferred embodiments and the accompanying drawings, which surely helps to comprehend the present invention.

Figure 2:
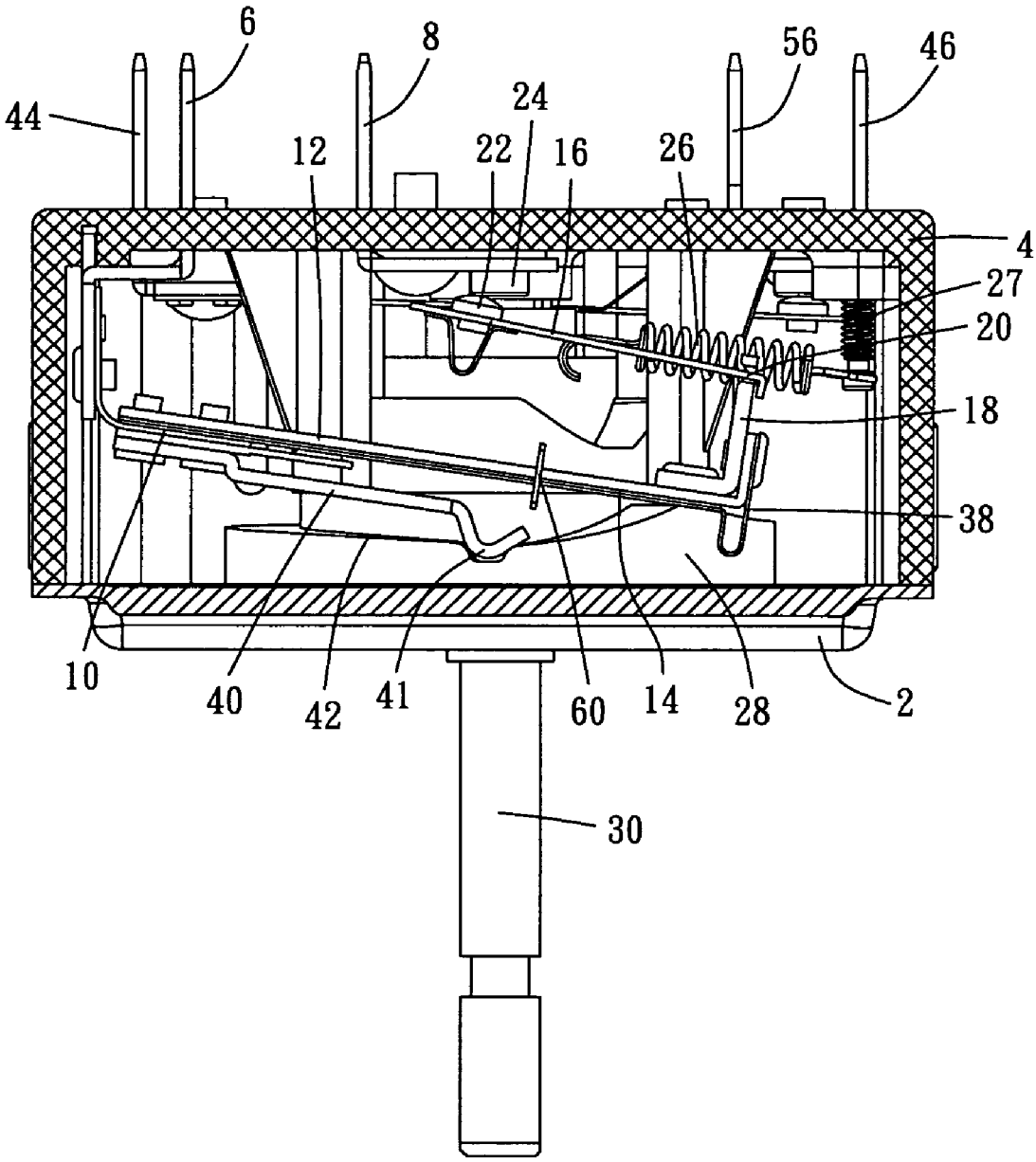
FIG. 2 is a sectional view showing the conducted status before the electric power is activated to heat in accordance with the exemplified embodiment of the present invention.
Figure 4:
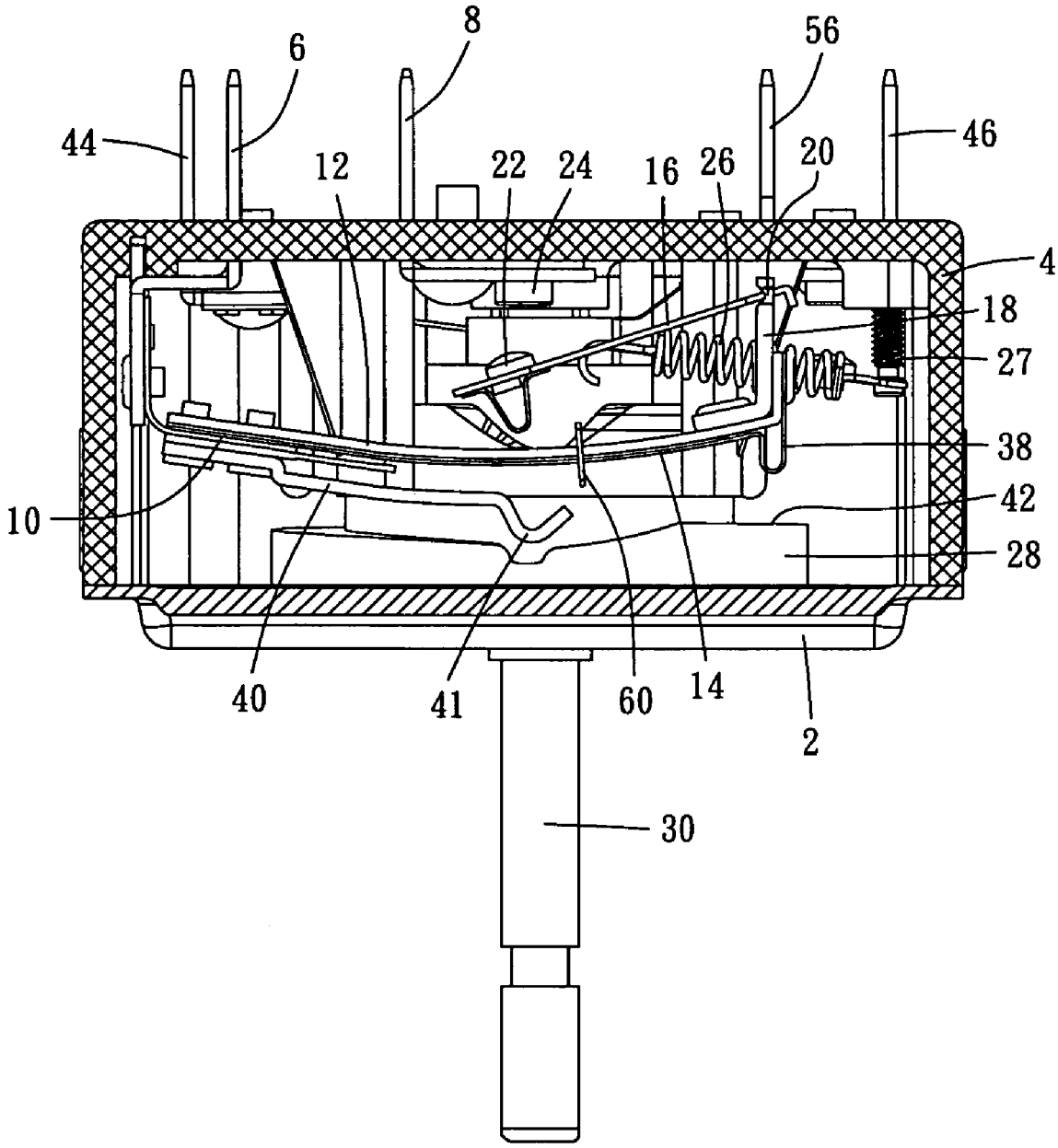
FIG. 4 is a sectional view showing the switch-off statuses after the electric power is activated to heat in accordance with the exemplified embodiment of the present invention.

Referring to the accompanying drawings of the present invention, the temperature control switch of the embodiment of the present invention comprises:

a switch casing, composed of a top 2 and a base 4;

a first control terminal 6, formed by having a conductive substance shaped into one piece, and setting it up on the base 4;

a second control terminal 8, formed by having a conductive substance shaped into one piece, and setting it up on the base 4;

a springy slice 10, better to be formed into L-shaped, connected electrically to the first control terminal 6 when assembling, for instance: through the connecting means such as the rivet or the electric welding, the two are joined together to form an electric connection;

a thermostatic bimetal strip 12, fastened to an end of the springy slice 10 in an insulated manner, and the insulation can be implemented by depositing an insulation layer between the springy slice 10 and the thermostatic bimetal strip 12, or by keeping the two a certain distance to form an insulated setup, and fastening the two by a fastener. Therefore, the thermostatic bimetal strip 12 will give birth to an elevated deformation on the spring slice 10, subject to the thermal effect due to a temperature change;

an electric heating device 14, set up on the thermostatic bimetal strip 12, as the electric heating device 14 is electrically conducted to heat, the resulting heat energy forces the thermostatic bimetal strip 12 to undergo an elevated deformation, where the electric heating device 14 comprises a first and a second ends, which form a series connection between the first control terminal 6 and the thermostatic bimetal strip 12;

an uplifted metal slice 16, having its one end to link the elevated end of the thermostatic bimetal strip 12, which is actually done by fastening the elevated end of the thermostatic bimetal strip 12 to a bracing slice 18 by a rivet, and the bracing slice 18 has a trough at each of its two sides, where the uplifted metal slice 16 is provided with a hook at each of the corresponding sides of its one end, and each hook is put into the corresponding trough, to form an incompletely fixed link point 20; while the other end of the uplifted metal slice 16 features a swaying contact 22, which is set up at the place corresponding to the contact point 24 that the second control terminal 8 joins; the backside of the swaying contact 22 is provided with a protruded portion 221;

a springy element 26, having its one end to fix at the switch casing by a fastener 27, and the other end to hook at a hole in the middle portion of the uplifted metal slice 16, which enables the resilience from the stretch due to the hooking, where the resilience pulls the uplifted metal slice 16 at the hooking; referring to FIGS. 2 & 4, since the uplifted metal slice 16 has its one end to link the bracing slice 18 to form an incompletely fixed link point 20, as the thermostatic bimetal strip 12 experiences no deformation or a tiny deflection, the link point 20 will be at relatively low position, while the swaying contact 22 at relatively top position (regarding to the position in FIG. 2), which also keeps an electric conduction with the contact point 24 of the second control terminal 8, shown in the status in FIG. 2; once the thermostatic bimetal strip 12 experiences an increasing elevated deformation, the link point 20 then goes down to exceed the line formed by the two ends of the springy element 26, and due to the resilience, the uplifted metal slice 16 soon yields uplifting at its both ends, which results in a separation between the swaying contact 22 and the contact point 24, and moves the swaying contact 22 down to a relative low position, while the link point 20 to the relative top position, shown in FIG. 4; and a regulation cam 28, set up inside the switch casing, and acting on the springy slice 10 through the chain action; a shaft 30, extending through the top 2 and the springy element 31 to connect fixedly to the regulative cam 28, so that by rotating the shaft 30, the regulative cam 28 can be activated to rotate.

The foresaid springy slice 10 can adopt a springy metal slice, which joins fixedly the first control terminal 6, such that the first end of the electric heating device 14 undergoes an electric connection with the first control terminal 6 through the metal slice.

Due to the limited space for the embodiment, the aforesaid electric heating device 14 can be realized as an alloy resistor, and can also be a structure of insulator with resistive windings. The foregoing mentioned alloy resistor and the thermostatic bimetal strip 12 can have a first insulated slice 32 in between, where the first insulated slice 32 can be a mica slice, and the mica slice is provided with rivet holes, which disables current to flow in the middle isolated portions between the thermostatic bimetal strip 12 and the electric heating device 14.

The aforesaid springy slice 10 can have a big circular hole at its bouncing end, and the thermostatic bimetal strip 12 corresponds to have a small circular hole, such that the springy slice 10, the first insulated slice 32, and the thermostatic bimetal strip 12 can be joined fixedly together through a rivet 34.

The aforesaid springy slice 10 is provided with a second insulated slice 36 at its other side, where the first insulated slice 32 and the second insulated slice 36 enable the thermostatic bimetal strip 12 completely to join the alloy resistor (an embodiment of the electric heating device 14) and the springy slice 10 at the riveting fixedly and in an insulation manner.

The alloy resistor features small resistivity yet big power per unit area, once it in series connection within the load circuits, for instance, in series with the heated pipe 2000~3000 W of the electric oven, a high current is allowed to pass. The type of the alloy resistor adopted for the present embodiment can be the one that is stuck on the thermostatic bimetal strip 12, with a size limited by the size of the thermostatic bimetal strip 12, where the alloy resistor is set around 10 W.

The aforesaid electric heating device 14 has its one end electrically connecting to the springy slice 10, while the other end of the electric heating device 14 electrically connecting to the other end of the thermostatic bimetal strip 12. The electric heating device 14 adopts an alloy resistor, where the first end of it connects electrically to the springy slice 10, and the first insulated slice 32 is set up between the alloy resistor and the thermostatic bimetal strip 12, besides, the first insulated slice 32 separates the thermostatic bimetal strip 12 from the alloy resistor to form an insulation status that prevents the short circuit of the two ends of the alloy resistor by the thermostatic bimetal strip 12.

The alloy resistor is provided with an arc portion 38 on its second end, which electrically connects to the elevated end of the thermostatic bimetal strip 12. Due to the alloy resistor is a thin article, and possesses a certain degree of elasticity, once the thermostatic bimetal strip 12 deforms by the heat, which will bring the springy slice 10 and the alloy resistor together into some extent of deformation, where the arc portion 38 will open to some extent due to its own deformation, which helps to elongate the alloy resistor, to adapt to the change of the thermostatic bimetal strip 12. Hence, any electric current flowed in the springy slice 10 will be conducted to one end of the electric heating device 14, and the electric heating device 14 conducts the current from its other end to the other end of the thermostatic bimetal strip 12. Since the electric heating device 14 is in series connection within a circuit and only one end of the thermostatic bimetal strip 12 connected to the circuit, the electric heating device 14 heats up, subject to the current flow, while the thermostatic bimetal strip 12 won't heat up but it will expose itself to the heat radiation within short distance.

As in the aforesaid, the thermostatic bimetal strip 12 won't be deformed without being subject to the heat; however, once it is subject to the heat to some extent (depending on the traits of the substance), a phenomenon of elevated deformation becomes apparent, where the deformation will get bigger. When the deformation drives the link point 20 down to pass the line formed by the two ends of the springy element 26, and due to the resilience by the springy element 26, the uplifted metal slice 16 soon yields uplifting at both ends, which keeps the swaying contact 22 apart from the contact point 24, and cuts off the electric power that disables the electric heating device 14 to heat.

Since the electric heating device 14 has been disconnected to heat, the thermostatic bimetal strip 12 starts to cool down, this helps to further diminish the elevated deformation, and in turn drives the uplifted metal slice 16 and the link point 20 to move up, to exceed the line formed by the two ends of the springy element 26. Due to the action by the resilience, the uplifted metal slice 16 soon yields anti-uplifting at both ends, which joins the swaying contact 22 with the contact point 24, and the electric power again enables the heat. Such a cycle forms a period of electric connection and disconnection. The length of the period is subject to the course of the elevated deformation.

The regulative cam 28 is provided with a first annular surface 42 near its lower annular rings, where the annular surface starts from the low end to step up gradually to the high end, which is a terminal fringe 43, and a notch 431 is formed on the location a bit higher than the terminal fringe 43. The springy slice 10 is provided with a regulative pole 40 thereon which is located toward the regulative cam 28, where the pole has an arc portion 41 at its bottom end. The foregoing description about the regulative cam 28 pressing to the springy slice 10 through the chain action can be realized by taking the first annular surface 42 to jostle against the arc portion 41 of the regulative pole 40. This means what the regulative pole 40 does is something like the arm of a lever; therefore, the motion of the arc portion 41 will exert on the regulative pole 40 to result a deflected motion, where the motion of the regulative pole 40 will in turn act on the springy slice 10, so that the effect of the first annular surface 42 of the regulative cam 28 jostles against the arc portion 41 is same as pressing on the springy slice 10. Through the chain action, the deflected motion of the springy slice 10 will again exert on the thermostatic bimetal strip 12. Take a step further; once the arc portion 41 is subject to the pressing by the first annular surface 42 at a non-lowest position, the arc portion 41 tends to have a course moving toward the direction of approaching the uplifted metal slice 16, which means the thermostatic bimetal strip 12 is already subject to the deflected motion, where its elevated end and the bracing slice 18 and the link point 20 are all moving toward the direction of approaching the uplifted metal slice 16. Therefore, once the thermostatic bimetal strip 12 deforms by the heat, the time for the link point 20 to pass the line formed by the two ends of the springy element 26 would be relatively shorter. In other words, the period of electric connection and disconnection of the electric heating device 14 is relatively shorter, which facilitates the high power heating appliance (for instance: electric oven), regulated by the temperature control switch of the present invention, to keep at a relatively lower temperature range.

Figure 3:
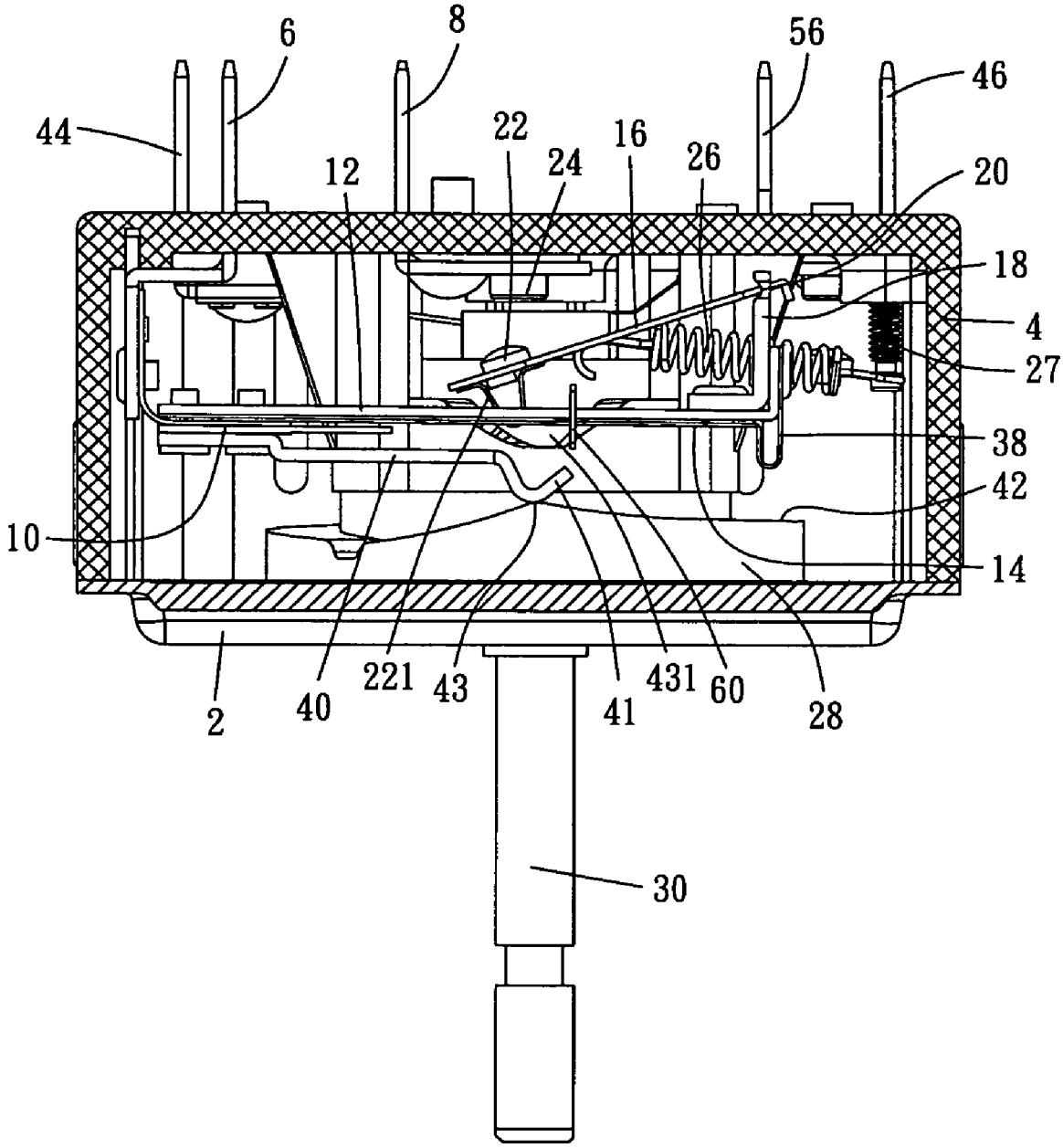
FIG. 3 is a sectional view showing the disconnected status by a direct regulation in accordance with the exemplified embodiment of the present invention.

During rotating the shaft 30 to activate the rotation of the regulative cam 28, the terminal fringe 43, the apex of the first annular surface 42, jostles against the arc portion 41 (the status shown in FIG. 3), which results in the maximum deflected momentum to the regulative pole 40, the springy slice 10 and the thermostatic bimetal strip 12, so that the elevated end of the thermostatic bimetal strip 12 and the link point 20 is forced to pass the line formed by the two ends of the springy element 26, which makes the uplifted metal slice 16 to yield uplifting at its both ends, again results in a separation between the swaying contact 22 and the contact point 24, and the protruded portion 221 at the backside of the swaying contact 22 is pushed to enter and stay in the notch 431, shown in FIG. 3. This means if the electric heating device 14 fails to heat the thermostatic bimetal strip 12 to get an elevated deformation, an alternative also works by manually rotating the shaft 30 to activate the rotation of the regulative cam 28, which directly separates the first and the second control terminals 6, 8.

As for rotating the shaft 30 to activate the rotation of the regulative cam 28, which enables the first annular surface 42 to jostle against the arc portion 41 from the top step down to the bottom (the status shown in FIG. 2), which means the potential energy that the thermostatic bimetal strip 12 gained from boosting to the high position has diminished (release). Due to the resilience of the thermostatic bimetal strip 12, where the elevated end of it, the bracing slice 18 and the link point 20 are all moving away from the uplifted metal slice 16 back to their initial positions. Once the thermostatic bimetal strip 12 is heated to deform, the time the link point 20 passes the line formed by the two ends of the springy element 26 would be relatively longer. In other words, the period of electric connection and disconnection of the electric heating device 14 is relatively longer, which facilitates the high power heating appliance (for instance: electric oven), regulated by the temperature control switch of the present invention, to keep at a relatively higher temperature range.

By activating the rotation of the regulative cam 28, where the way the first annular surface 42 jostles against the arc portion 41 can be changed (from the loose to the tight or from the tight to the loose, subject to the demand), and the period of electric connection and disconnection of the electric heating device 14 can then be changed, which enables the high power heating appliance, regulated by a temperature control switch, to keep at a predetermined temperature range, where the predetermined temperature range is changeable. When not in use, the electricity can be cut off also by winding the regulative cam 28.

Figure 5:
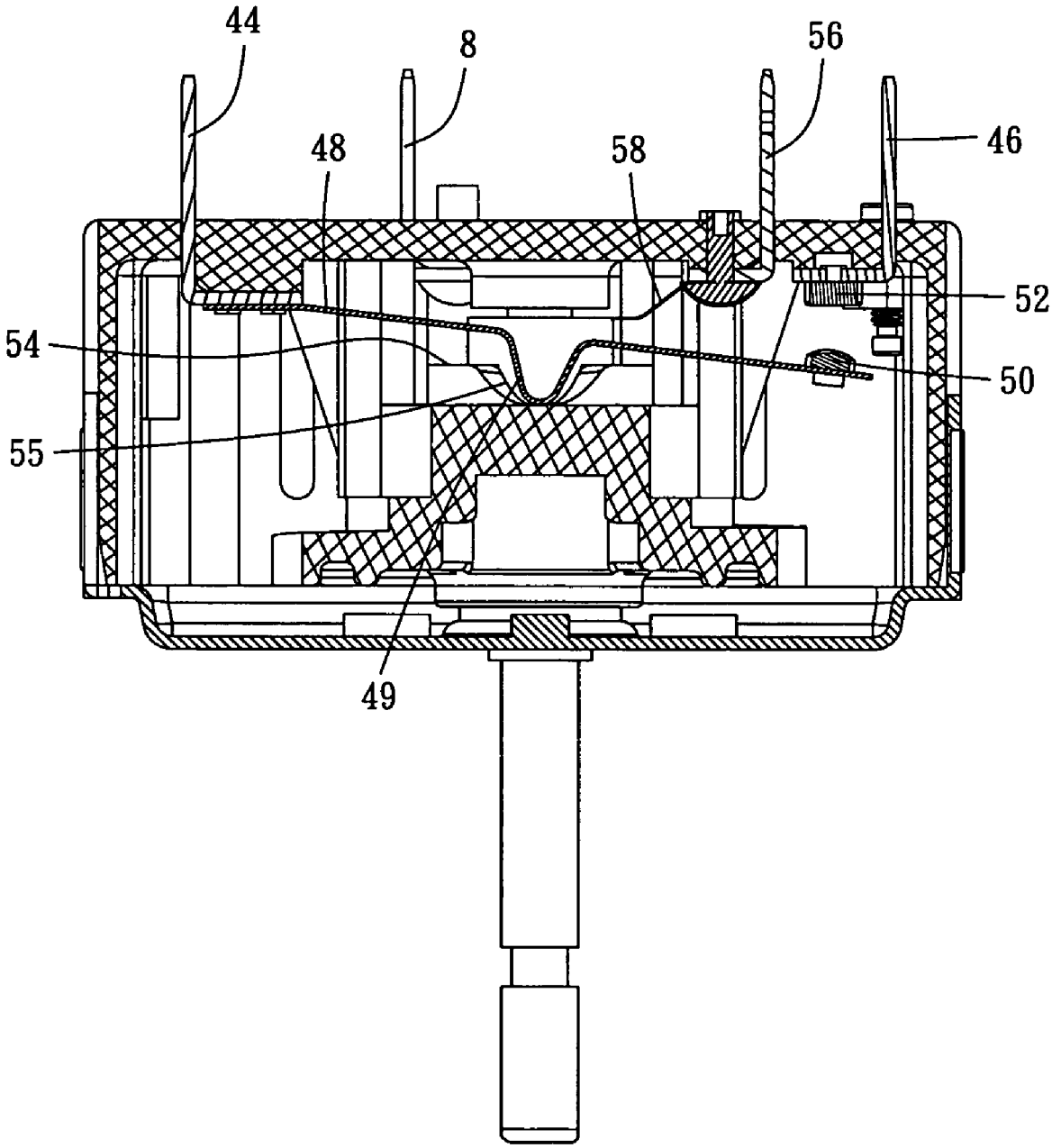
FIG. 5 is a sectional view showing the switch-off statuses for a different portion of the exemplified embodiment of the present invention.
Figure 6:
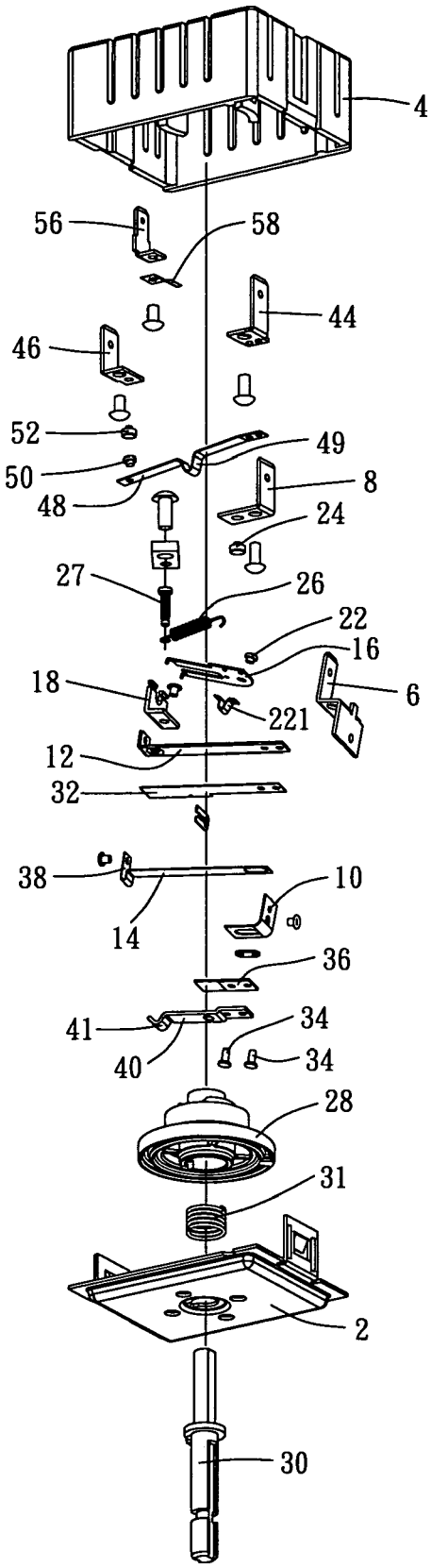
FIG. 6 is a three-dimensional exploded view from a different angle in accordance with the exemplified embodiment of the present invention.

The switch casing is further provided with third control terminal 44 and fourth control terminal 46, where the third control terminal 44 has a deflected springy slice 48 which is provided with a protruded portion 49 in the middle and a dynamic contact point 50 near the bottom, while the fourth control terminal 46 has a fixed contact point 52 which offers the contact and conductivity to the dynamic contact point 50. The foresaid regulative cam 28 is provided with a second annular surface 54 at the top of the notch 431, and the second annular surface 54 is provided with a cavity 55 (shown in FIG. 5), where the cavity 55 and the notch 431 are separated at a 180 degree angle. During assembly, the second annular surface 54 is elastically pressing on the protruded portion 49 of the deflected springy slice 48, where the deflected springy slice 48 is then undergone a jostle, which drives the dynamic contact point 50 and the fixed contact point 52 into contact for conduction. Through the rotation of the regulative cam 28, the cavity 55, on the second annular surface 54, can be turned to align with the protruded portion 49, which makes the protruded portion 49 right falls into the cavity 55 (shown in FIG. 5). The deflected springy slice 48 then is free of the pressing and returns to its original position through its resilience, which keeps the dynamic contact point 50 apart from the fixed contact point 52.

When in use, the first control terminal 6 and the second control terminal 8, and the third control terminal 44 and the fourth control terminal 46, constitute two set of switches respectively, where each set can be connected in series with the hard line and the ground line. When the third control terminal 44 and the fourth control terminal 46 are in open-circuit, no matter the first control terminal 6 and the second control terminal 8 are in switch-on or in switch-off, the period of electric connection and disconnection of the electric circuit can not be changed. Only the third control terminal 44 and the fourth control terminal 46 are in close-circuit, the first control terminal 6 and the second control terminal 8 are available in realizing the regulation of the period of electric connection and disconnection.

The switch casing is further provided with a fifth control terminal 56, where the fifth control terminal 56 is again provided with a springy slice 58, once the dynamic contact point 50 of the deflected springy slice 48 joins the fixed contact point 52, the deflected springy slice 48 will join the springy slice 58. The fifth control terminal 56 can be connected to a terminal of an indication lamp, which is connected in series within a circuit for indicating conduction purpose.

Besides, the foregoing electric heating device 14 and the first insulated slice 32 are further provided with a filling slice 60 in between, to moderately limit the joint between the electric heating device 14 and the first insulated slice 32. Moreover, the springy slice 10 and the second insulated slice 36 are further provided with a spacer 62 in between, to solidify the joint between the springy slice 10 and the second insulated slice 36.

Even if the preferred embodiment of the present invention has been disclosed by the foresaid description and accompanying drawings, it is understood that the foresaid is merely an exemplified embodiment of the present invention; therefore, the subject matter of all the viewpoints of the embodiment unveiled herein is to be considered illustrative, not restrictive. The scope of the present invention is to be determined by the permissible interpretation of the following claims and their equivalents, and shell not be restricted by the foresaid description.

What is claimed is:

1. A temperature control switch assembly, comprising:

a switch casing, composed of a top and a base;

a first control terminal, formed by having a conductive substance shaped into one piece, and setting it up on the base;

a second control terminal, formed by having a conductive substance shaped into one piece, setting it up on the base, and joining it to a contact point;

a springy slice, connected electrically to said first control terminal;

a thermostatic bimetal strip, having one end to join fixedly said springy slice in an insulated manner, while the other end features an elevated end;

an electric heating device, set up on said thermostatic bimetal strip, where said electric heating device comprises a first end and a second end, which form a series connection between said first control terminal and said thermostatic bimetal strip;

an uplifted metal slice, having one end to join the elevated end of said thermostatic bimetal strip, to form an incompletely fixed link point, while the other end features a swaying contact, which is set up at a position corresponding to the contact point that said second control terminal joins;

a springy element, having one end fastened at said switch casing by a fastener, and the other end hooking the center portion of said uplifted metal slice, which enables a resilience from a stretching due to the hooking, where the resilience pulls said uplifted metal slice at a hook; and a regulation cam, set up inside said switch casing, and exerting a force on said springy slice through a chain action.

2. The temperature control switch assembly according to claim 1 wherein said springy slice is a springy metal slice, and fixedly joins said first control terminal, such that the first end of said electric heating device connecting electrically to said first control terminal through the springy metal slice.

3. The temperature control switch assembly according to claim 1 or 2 wherein said electric heating device is an alloy resistor, where a first insulated slice is set up between the alloy resistor and said thermostatic bimetal strip.

4. The temperature control switch assembly according to claim 3 wherein the alloy resistor is set up on the backside of said thermostatic bimetal strip.

5. The temperature control switch assembly according to claim 3 wherein the first end of the alloy resistor connects fixedly and electrically to the springy metal slice, and the springy metal slice is provided with a bouncing end set up in between said alloy resistor and the first insulated slice.

6. The temperature control switch assembly according to claim 5 wherein the second end of the alloy resistor connects fixedly and electrically to the elevated end of said thermostatic bimetal strip.

7. The temperature control switch assembly according to claim 6 wherein the alloy resistor is provided with an arc portion on the second end, which connects fixedly and electrically to the elevated end of said thermostatic bimetal strip.

8. The temperature control switch assembly according to claim 1 or 2 wherein said springy slice is provided with a regulative pole thereon which is located toward said regulative cam, and the regulative pole has an arc portion at its bottom end, where said regulative cam acts on the arc portion and again to said springy slice through the chain action.

9. The temperature control switch assembly according to claim 8 wherein said regulative cam is provided with a first annular surface thereon, where the annular surface starts from a low end to step up gradually to a high end which is a terminal fringe, and the action being done by taking the first annular surface jostling against the arc portion of the regulative pole.

10. The temperature control switch assembly according to claim 1 or 2 wherein said switch casing is provided with third and fourth control terminals, wherein the third control terminal has a deflected springy slice which is provided with a dynamic contact point near its bottom end, the fourth control terminal has a fixed contact point which conductively joins the dynamic contact point of the deflected springy slice, and said regulative cam is provided with a second annular surface, where an action is performed by pressing the second annular surface on the deflected springy slice.

* * * * *